US011396830B2

(12) United States Patent
Rezkalla

(10) Patent No.: US 11,396,830 B2
(45) Date of Patent: Jul. 26, 2022

(54) OIL CONTROL ASSEMBLY AND ENGINE SYSTEM FOR VARIABLE VALVE ACTUATION

(71) Applicant: Eaton Intelligent Power Limited, Dublin (IE)

(72) Inventor: Ramy Rezkalla, Kalamazoo, MI (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 17/480,028

(22) Filed: Sep. 20, 2021

(65) Prior Publication Data

US 2022/0003131 A1 Jan. 6, 2022

Related U.S. Application Data

(63) Continuation of application No. 16/970,457, filed as application No. PCT/EP2019/025043 on Feb. 14, 2019, now Pat. No. 11,125,119.

(Continued)

(51) Int. Cl.
*F01L 1/24* (2006.01)
*F01L 1/18* (2006.01)

(Continued)

(52) U.S. Cl.
CPC ..... *F01L 1/2411* (2013.01); *F01L 1/18* (2013.01); *F01L 1/181* (2013.01);

(Continued)

(58) Field of Classification Search
CPC . F01L 1/181; F01L 1/2411; F01L 2001/2444; F01L 1/26; F01L 1/267;

(Continued)

(56) References Cited

U.S. PATENT DOCUMENTS 6,505,589 B1 1/2003 Hayman et al.
6,718,940 B2 * 4/2004 Usko ..... F01L 1/181 123/90.36

(Continued)

FOREIGN PATENT DOCUMENTS

CN 101124387 A 2/2008
CN 101113680 B 6/2010

(Continued)

OTHER PUBLICATIONS

International Search Report and Written Opinion for PCT/EP2019/025043 dated May 7, 2019; pp. 1-12.

*Primary Examiner* — Jorge L Leon, Jr.
(74) *Attorney, Agent, or Firm* — Mei & Mark, LLP

(57) ABSTRACT

An engine system and valvetrain can comprise a rocker shaft combined with a first block, a first cylinder deactivation oil control valve in the first block, a second cylinder deactivation oil control valve in the first block. Also, a second block can be combined with the rocker shaft with a third cylinder deactivation oil control valve and an early exhaust valve opening oil control valve in the second block. The rocker shaft can comprise oil infeeds and oil outfeeds configured for supplying hydraulic pressure to the first and second blocks, the blocks can distribute the pressure to the control valves, and the blocks can return pressure to the rocker shaft. Intake and exhaust rocker arms can receive the returned pressure to actuate valves, and the rockers arms can be arranged line-to-line with no overlap during motion.

18 Claims, 12 Drawing Sheets

Related U.S. Application Data

(60) Provisional application No. 62/631,491, filed on Feb. 15, 2018.

(51) Int. Cl.

| | |
|---|---|
| ***F01L 13/00*** | (2006.01) |
| ***F02D 13/02*** | (2006.01) |
| ***F02D 13/06*** | (2006.01) |
| *F01L 1/26* | (2006.01) |

(52) U.S. Cl.

CPC ..... *F01L 13/0005* (2013.01); *F02D 13/0203* (2013.01); *F02D 13/06* (2013.01); *F01L 1/26* (2013.01); *F01L 1/267* (2013.01); *F01L 2001/2444* (2013.01); *F01L 2013/001* (2013.01); *F02D 13/0242* (2013.01)

(58) Field of Classification Search

CPC ..... F01L 13/0005; F01L 2013/001; F01L 2800/16; F01L 2810/02; F02D 13/0242; F02D 13/06

USPC ..... 123/90.15, 90.16, 90.27, 90.36, 90.4, 123/90.44, 90.46, 198 F

See application file for complete search history.

(56) References Cited

U.S. PATENT DOCUMENTS

| | | | | |
|---|---|---|---|---|
| 7,475,659 | B2 | 1/2009 | Amell | |
| 7,699,030 | B2 | 4/2010 | Nomura | |
| 10,151,223 | B2 | 12/2018 | McConville | |
| 2005/0241611 | A1 | 11/2005 | Weber et al. | |
| 2007/0193543 | A1* | 8/2007 | Best | F01L 13/0005 123/90.39 |
| 2008/0302322 | A1* | 12/2008 | Edelmayer | F01L 1/181 123/90.39 |
| 2009/0178637 | A1 | 7/2009 | Gecim et al. | |
| 2016/0281612 | A1* | 9/2016 | Toth | F01L 13/08 |
| 2017/0167319 | A1 | 6/2017 | Kim et al. | |
| 2017/0284313 | A1* | 10/2017 | Shewell | F01L 13/0026 |

FOREIGN PATENT DOCUMENTS

| | | | |
|---|---|---|---|
| CN | 104153906 | A | 11/2014 |
| CN | 107489542 | A | 12/2017 |
| EP | 2984325 | B1 | 6/2019 |
| JP | 2014043830 | A | 3/2014 |
| WO | 1999032773 | A1 | 7/1999 |
| WO | WO-2011/015603 | A2 | 2/2011 |
| WO | WO-2017/127219 | A1 | 7/2017 |
| WO | WO-2017/177102 | A1 | 10/2017 |

* cited by examiner

OIL CONTROL ASSEMBLY AND ENGINE SYSTEM FOR VARIABLE VALVE ACTUATION

PRIORITY

This is a continuation of U.S. Ser. No. 16/970,457 filed Aug. 17, 2020, which is a § 371 National Stage entry of Patent Cooperation Treaty Application No. PCT/EP2019/025043, filed Feb. 14, 2019, which claims the benefit of U.S. provisional application No. 62/631,491, filed Feb. 15, 2018, all of which are incorporated herein by reference and relied upon for the benefit of priority.

FIELD

This application relates to engine system and component designs to enable variable valve actuation and cylinder control comprising cylinder deactivation and cylinder deactivation with early exhaust valve opening.

BACKGROUND

It is desired to offer variable valve actuation comprising two or more modes, such as a nominal engine operation mode and a second engine operation mode. The control circuits can be complex and can require multiple engine cycles to switch between the nominal and the second engine operation modes. When oil controlled, the valvetrain can comprise a large number of oil control valves ("OCVs") such as one per each valve per engine operation mode. This number of OCVs increases size, weight, and complexity of the engine system. Such dual mode operation can also have complexities from overlapping or overlaying one valvetrain component over another.

SUMMARY

The methods and devices disclosed herein overcome the above disadvantages and improve the art by way of a rocker shaft that reduces the complexity of the oil control circuit, blocks for mounting oil control valves to the rocker shaft to enable multiple engine operation modes, hydraulic capsules that are configured for hydraulic and mechanical lash adjustment, a rocker arm configuration that is sequenced on the rocker shaft to avoid overlapping the arms of the rocker arms, and an engine system comprising combinations of some or all of the rocker shaft, blocks, capsules, and rocker arms.

Engine systems consistent with the disclosure can comprise a rocker shaft comprising a first cylinder deactivation oil infeed for supplying hydraulic pressure to a first cylinder deactivation oil control valve and a second cylinder deactivation oil control valve in a block. The rocker shaft can comprise first and second cylinder deactivation oil outfeeds, the first cylinder deactivation oil outfeed for connection to the first cylinder deactivation oil control valve and the second cylinder deactivation outfeed for connection to the second cylinder deactivation oil control valve.

The rocker shaft can further comprise a second cylinder deactivation oil infeed for supplying hydraulic pressure to a third cylinder deactivation oil control valve and to an early exhaust valve opening oil control valve in a block. A third oil outfeed can be for connection to the third cylinder deactivation oil control valve. A fourth oil outfeed can be for connection to the early exhaust valve opening oil control valve.

A valvetrain in an engine system can comprise a first, a second, and a third cylinder for combustion. A first, a second, and a third set of intake valves can be respectively paired with the first, second, and third cylinders, each of the first, second, and third sets of intake valves comprising a respective intake rocker arm over a respective intake bridge. Each of the intake rocker arms comprises a hydraulic capsule, and each respective intake bridge is configured to act on its respective set of intake valves. A first, a second, and a third set of exhaust valves can be respectively paired with the first, second, and third cylinders. Each of the first, second, and third sets of exhaust valves can comprise a respective exhaust rocker arm over a respective exhaust bridge. Each of the exhaust rocker arms can comprise a hydraulic capsule. Each respective exhaust bridge can be configured to act on its respective set of exhaust valves. A first, a second, and a third early exhaust valve opening ("EEVO") rocker arm can be respectively paired with the first, second, and third sets of exhaust bridges, wherein each EEVO rocker arm comprises an EEVO hydraulic capsule.

The engine system and valvetrain can comprise, and the rocker shaft can be combined with, a first block, a first cylinder deactivation oil control valve in the first block, a second cylinder deactivation oil control valve in the first block.

The engine system and valvetrain can comprise, and the rocker shaft can be combined with, a second block, a third cylinder deactivation oil control valve in the second block, and an early exhaust valve opening oil control valve in the second block. A second cylinder deactivation oil infeed can be for supplying hydraulic pressure to the third cylinder deactivation oil control valve and to the early exhaust valve opening oil control valve in a block. A third oil outfeed can be connected to the third cylinder deactivation oil control valve. A fourth oil outfeed can be connected to the early exhaust valve opening oil control valve.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DESCRIPTION

Figure 1:
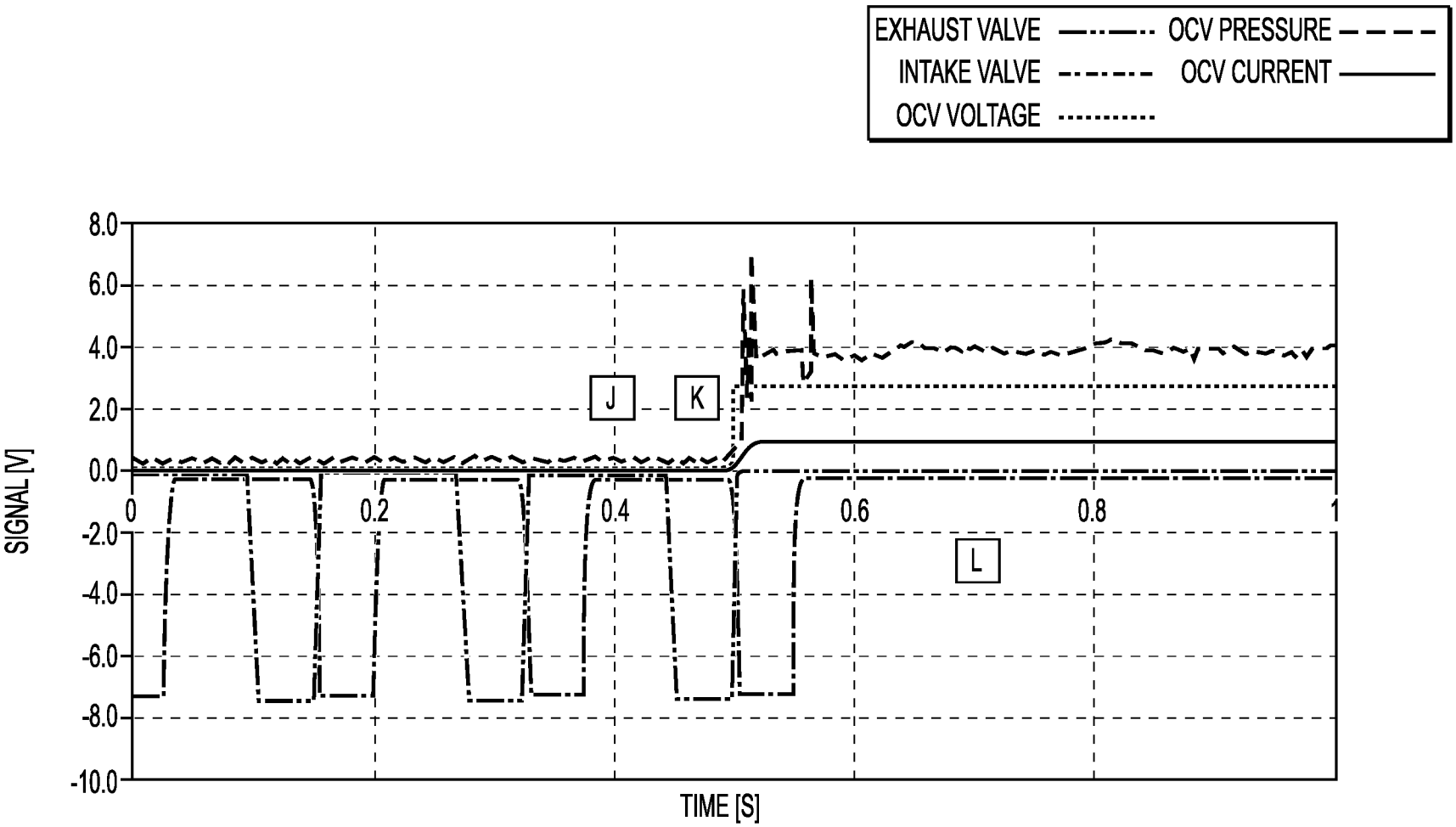
FIG. 1 illustrates signals over time for an engine transitioning from normal operation mode to cylinder deactivation operation mode.

Reference will now be made in detail to the examples which are illustrated in the accompanying drawings. Wherever possible, the same reference numbers will be used throughout the drawings to refer to the same or like parts. Directional references such as "left" and "right" are for ease of reference to the figures.

An engine system 10 such as on a Cummins ISX15 engine, can comprise six cylinders 20 and a valvetrain 34 configured for normal operation mode, cylinder deactivation operation mode ("CDA"), and early exhaust valve opening ("EEVO") to provide variability and controllability at each cylinder. The engine system 10 can operate variably in a combination of cylinder deactivation operation mode and early exhaust valve opening operation mode. With appropriate oil control in combination with a rocker shaft 500, half-engine, full engine, and individual cylinder operation modes can be configured and selected. For example, the engine can be configured for full engine CDA, half engine CDA, or individual cylinder CDA so that any number of the engine cylinders can operate in CDA. Using the disclosed engine system 10, the rockers arms 600, 900 can be arranged line-to-line with no overlap during motion while enabling selective implementation of EEVO on some valves.

Variable valve actuation (VVA) can be accomplished by using combinations of hydraulic capsules, such as a cylinder deactivation capsule 700 and an early exhaust valve opening capsule 800. The hydraulic capsules can have combinations of hydraulic and mechanical lash setting functionality, or one or the other of lash adjustment functionalities. By using other hydraulic capsules, other VVA functionality can be achieved. For example, it is possible to exchange an early exhaust valve closing capsule for the EEVO capsule, or arrange the second hydraulic capsule on the intake valve bridge instead of the exhaust valve bridge so that early intake valve opening or closing is the functioning hydraulic capsule instead of the EEVO capsule.

Such an engine system 10 comprises modifications to enable CDA on all of the intake valves I111-I162 and on all of the exhaust valves E111-E162. Further complementary modifications are needed to enable EEVO on a subset of exhaust valves E111, E121, E131, E141, E151, & E161. A goal is to limit the total amount of hardware while maximizing the functionality. Serviceability and synchronous valve operation are additional goals. Through novel optimizations of the rocker shaft 500, and through new oil control valve mounting blocks 80, 90, the first and third goals can be achieved. The location and orientation of new OCV mounting blocks 80, 90 permit serviceability, as do additional modifications discussed below on the cylinder deactivation capsules ("CDA capsules") 700 and early exhaust valve opening capsules ("EEVO capsules") 800.

Figure 6:
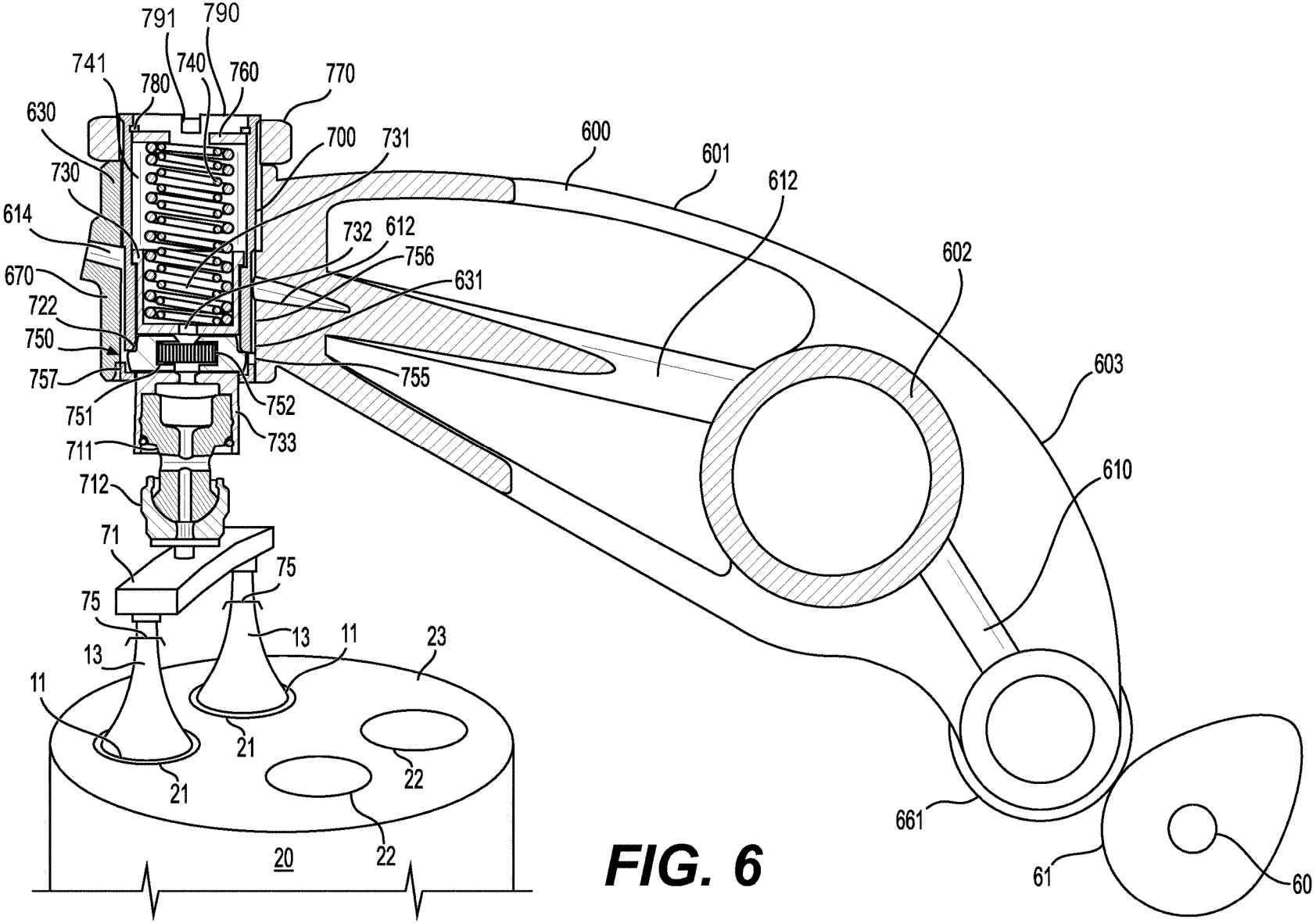
FIG. 6 is a cross-section view of a rocker arm configured for implementing cylinder deactivation operation mode.
Figure 7:
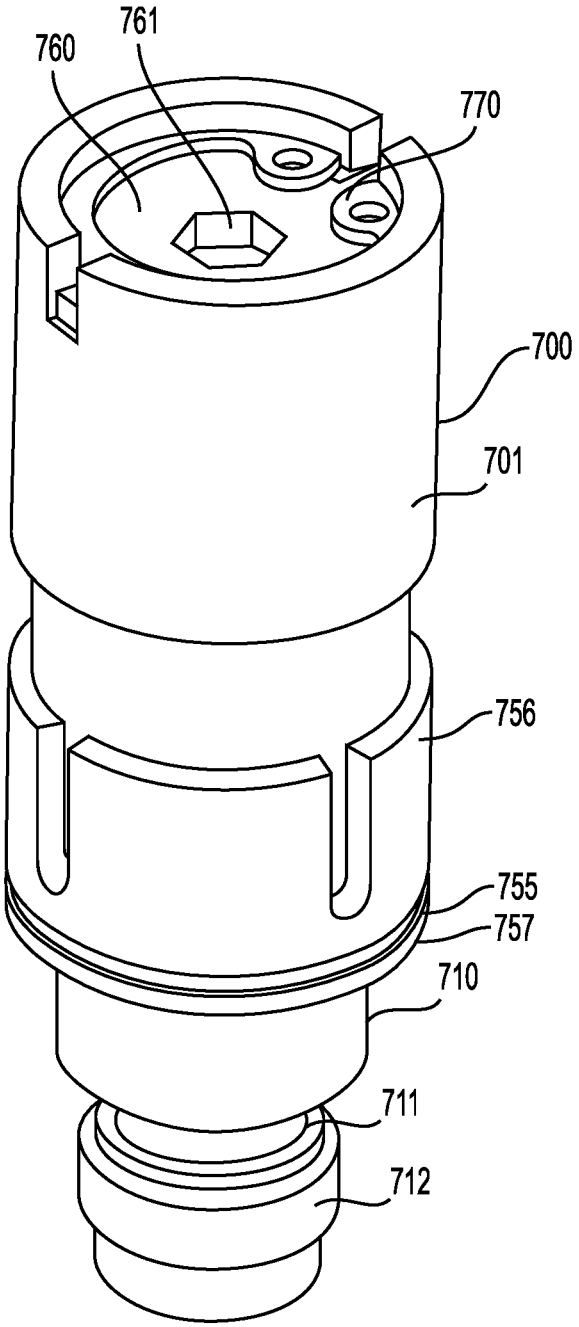
FIG. 7 is a view of a cylinder deactivation capsule and e-foot combination.

The engine system 10 is an in-line, 6-cylinder, type III engine. A cam rail 60 spins under the rocker arms 600 & 900. Eccentric cam lobes 61 & 62 are respectively paired with the rocker arms 600 & 900 to press on respective rollers 661, 962. The eccentricities of the respective cam lobes 61 & 62 are selected to time the motion of the rocker arms so that they pivot about the rocker shaft 500 to lift and lower respective intake valves I111-I162 and exhaust valves E111-E162. Intake rocker arms 611, 612, 613, 614, 615, 616 in this example provide only normal operation mode or cylinder deactivation operation mode. However, additional modifications are not excluded to enable additional functionality such as early or late intake valve opening or closing (EIVO, EIVC, LIVO, LIVC). A pair of intake valves 13 is shown in FIG. 6, yet note that the rocker arm 600 of FIG. 6 can also be used with modifications to the trajectory of the arm 601 for actuating a pair of exhaust valves 14. Intake rocker arms 611, 612, 613, 614, 615, 616 are configured with an elephant foot ("e-foot") 712 to push down on respective intake valve bridges 71. Two intake valves 13 are connected to each intake valve bridge 71, and spring biasing mechanisms 74 are included between a valvetrain mounting bracket 40 and seats 75 on the valve stems to encourage the intake valves to return to a closed position. Valve heads 11 can open and close intake ports 11 in the cylinder head 23 of exemplary cylinder 20.

Figure 9:
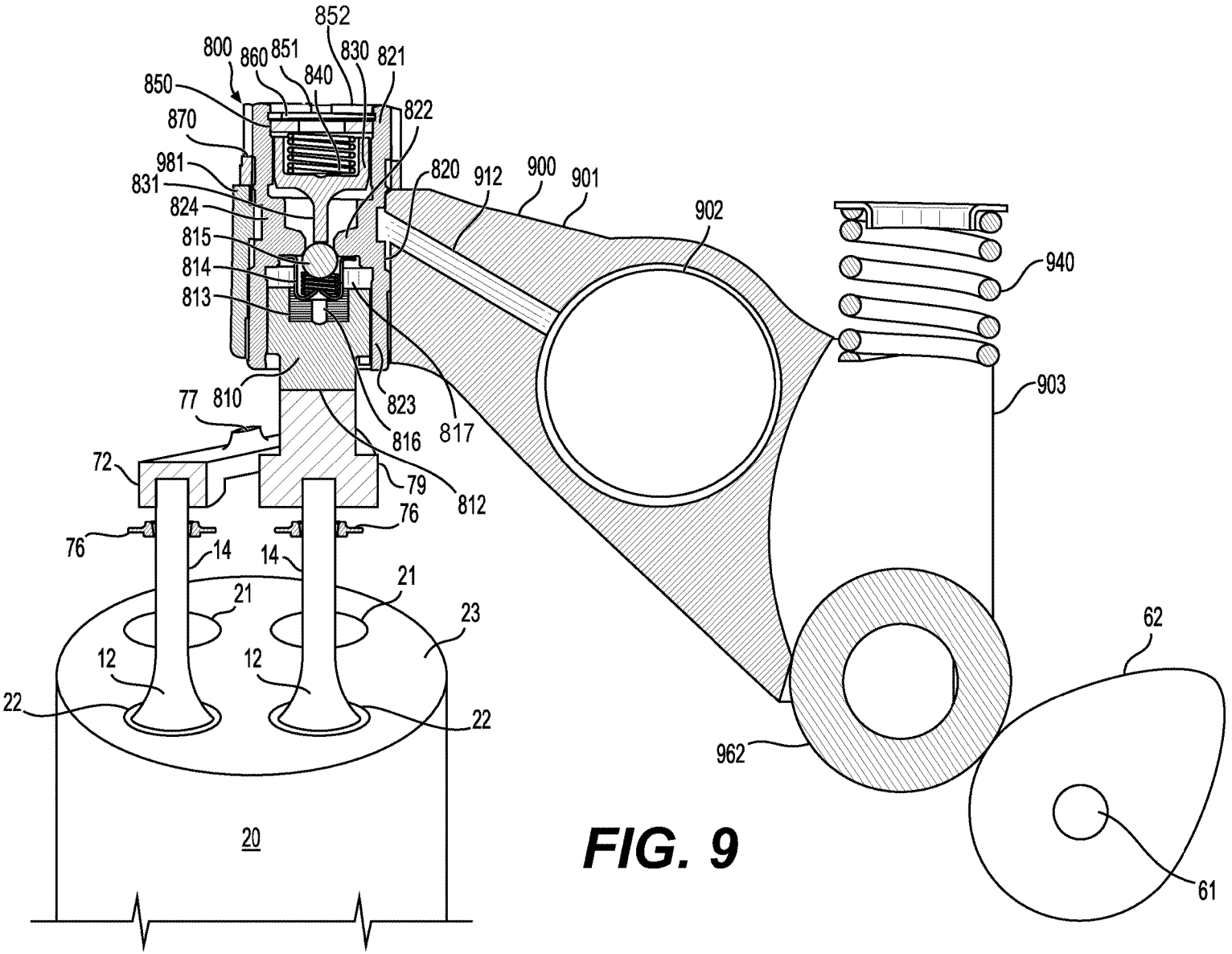
FIG. 9 is a view of a rocker arm configured for implementing early exhaust valve opening operation mode.

Two exhaust valves 14 are shown in FIG. 9 connected to an exhaust valve bridge 72. A CDA rocker arm 600 can be configured to press on exhaust valve bridge 72 at location 77. Exhaust valve bridge can comprise a through-hole and valve cleat 79. When the CDA rocker arm 600 presses on location 77, the force from the CDA rocker arm 600 is transferred to the exhaust valve bridge 72 to the valve stem ends, and the exhaust valve heads 12 can move respect to exhaust ports 22 in cylinder head 23 of cylinder 20. Spring biasing mechanisms 74 are included between the valvetrain mounting bracket 40 and seats 76 on the valve stems to encourage the exhaust valves 14 to return to a closed position. When EEVO is desired, EEVO rocker arm 900 can press on valve cleat 79 but not on exhaust valve bridge 72. Force from EEVO rocker arm 900 transfers to one of the valves 14 to actuate that valve according to the timing on cam lobe 62 and as controlled by oil pressure in EEVO capsule 800.

It is possible to provide a single oil control valve for enabling CDA for all valves of a cylinder. A single oil control valve can control both intake and exhaust valve CDA functionality. So, in FIG. 10, CDA oil control valves are labeled 1-6 for the six cylinders illustrated. Schematically, hydraulic lines for CDA are shown with squares on the lines 5201-5206. An oil control valve ("OCV") 1-6 receives fluid at a baseline pressure at all times, and the corresponding OCV is controlled to open or close to shunt the oil to the CDA capsules over the rocker arm bridges of the intake and exhaust valves. So, OCV 1 can control CDA oil pressure to intake CDA capsule I1 on the first intake bridge and also exhaust CDA capsule E1 on first exhaust bridge. OCV 2 controls intake and exhaust CDA capsules I2 & E2, and so on for OCVs 3-6 and CDA capsules I3-I6 & E3-E6.

Figure 2:
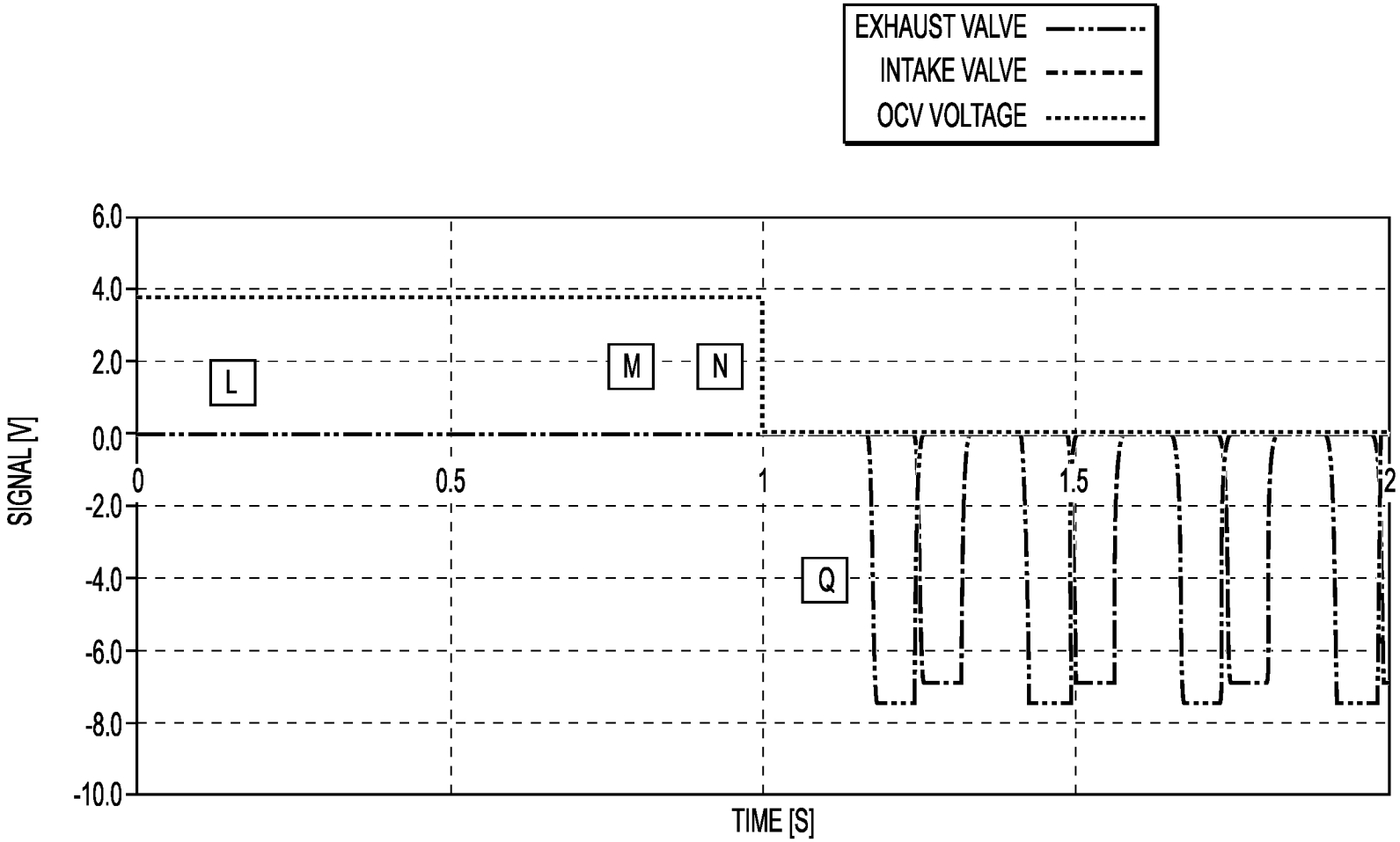
FIG. 2 illustrates signals over time for an engine transitioning from a cylinder deactivation operation mode to a normal operation mode.
Figure 3:
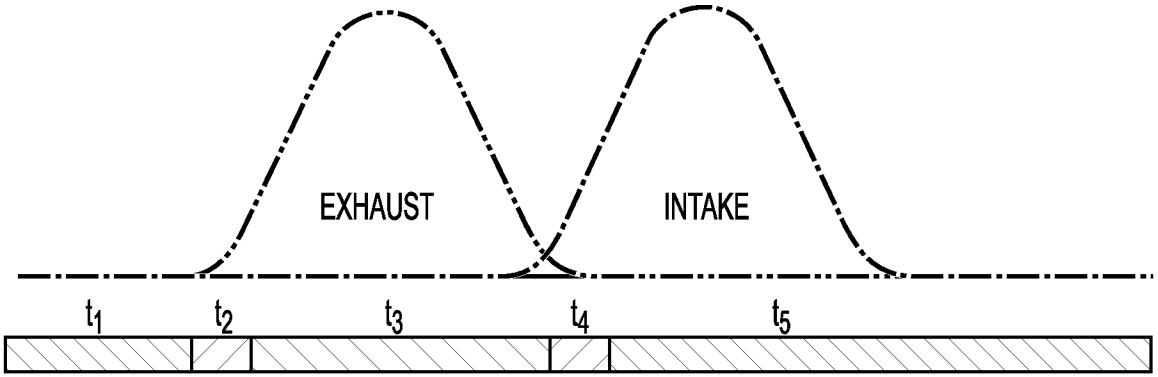
FIG. 3 illustrates switching windows for timing signals with respect to valve opening and closing.

Advantages of using the single CDA capsule as described can be explained by looking to FIGS. 1-3. It is understandable that an intake or exhaust valve has a timing for lifting and lowering to perform their respective functions of opening and closing the intake and exhaust ports 21, 22 of the cylinder 20. If opening and closing occurs at the correct timing, there is little risk of the valve heads 11, 12 hitting the reciprocating piston in the cylinder. By using a single CDA capsule to deactivate all valves of a cylinder, there is no valve motion mismatch as might occur when using a separate OCV for each valve or for each intake and each exhaust rocker arm. Total hardware reduction improves predictably in the synchronous operation of the intake and exhaust valves entering CDA and reactivating and improves the predictability and synchronous operation of the exhaust valves entering and exiting EEVO.

The signals in volts and the time in seconds are exemplary only and provided to lend relative relationships to FIGS. 1 & 2 and not as a means to restrict the disclosure to the relative scale applied. Normal operation mode is shown from time zero to time 0.4 s in FIG. 1. The intake and exhaust valve pairs lift and lower according to their baseline timings. The oil control valve, in this example a CDA OCV, receives no active signal and the CDA OCV can be in a passive mode (closed or configured to supply a baseline through-pressure). At area J, a user or pre-programmed control algorithm can signal that CDA is desired on these valves. A failsafe algorithm can run during area K to select the correct timing to signal the OCV to enter an active mode (open or configured to supply active mode pressure comprising baseline through-pressure plus an actuation pressure). OCV pressure increases over the baseline as the OCV voltage and OCV current appear as part of the signal profile. The CDA capsule 700 receives the active mode pressure to unlatch the CDA latches permitting inner capsule collapse during rocker arm motion. The intake and exhaust valve motion flatlines in area L indicating that CDA is successfully entered and the valve motion is deactivated.

FIG. 2 shows that the OCV voltage is applied in areas L, M, & N and the OCV pressure and OCV current are omitted for brevity. Area L remains indicative of cylinder deactivation operation mode. To reactivate or recharge (reduce vacuum or pumping losses) the valves, area M indicates a time where the user or a pre-programmed control algorithm can signal that normal operation mode is desired on these valves. A failsafe algorithm can run during area N to select the correct timing to signal the OCV to return to passive mode. An electronic control unit (ECU) as a main computer or sub processor such as a cylinder deactivation mode controller can run each failsafe or preprogrammed mode selection control algorithm. With termination of OCV voltage in area Q, OCV pressure and OCV current drop. The CDA latch can overcome baseline (passive mode) oil pressure to re-latch in the CDA capsule. The cylinder is then active for subsequent cycles and normal operation mode can continue on the valves.

The need for failsafe and the benefit of predictable synchronous valve operation can be seen in FIG. 3. For a time in the actuation cycle of a cylinder, it is safe to convert the valves from an active mode to a deactivated CDA mode. The piston reciprocates up and down in each cylinder in a pattern that can be tracked and coordinated within the failsafe and mode selection algorithms. So, when the piston is sufficiently distanced from the valve heads 11, 12, such as at times t1 & t5, the switch from one mode to another can be safely started without risk that the valve heads would strike the piston head. At times t2 and t4, the switch is not available because of the risk of a critical shift that could result in valve head contact with the reciprocating piston. Should a user or other programming request implementation of CDA or EEVO during times t2 or t4, the request would not be honored by activating the OCV with the OCV voltage and OCV current signals. The failsafe algorithm would delay honoring the request until t1 or t5. In some instances, it is permissible to activate the OCV during time t3, but doing so would activate or deactivate the intake valves before the exhaust valves. In other instances, activating the OCV during time 3 would be considered a missed time shift of an unideal nature. When a single OCV, such as OCV 1, controls the deactivation of all valves of a cylinder, such as valves 13 & 14 of cylinder 20, there is less mismatch in the valve motion. Synchrony in the response time of the valves, due to singular and known response time of the single OCV, results in less processing burden and variance in actual operation of the valves. There are fewer tolerances in determining whether the OCVs can satisfy the constraints of times t2 & t4, where switching is not permitted, and thus less processing burden. The one OCV per all valves of the cylinder will have two prohibited periods t2 & t4 with one known response time for the one OCV used for determining whether the switching window constraints can be met. This is instead of two instances of four prohibited periods and four OCV response times to process, as would occur if each valve had a dedicated OCV to deactivate or reactivate it. The one OCV scenario improves processing burdens and reduces opportunities for critical shifts over valvetrains having one OCV for the exhaust valves and one OCV for the intake valves. This latter engine system would have two OCV response times to process and four prohibited periods spanning an instance of t2 for opening the exhaust, an instance of another prohibited time for closing the exhaust, an instance of t4 for opening the intake and an instance of a prohibited time for closing the intake valves. It is thus nontrivial to reduce the number of OCVs per cylinder. Like benefits can be extrapolated for the EEVO mode. Instead of an EEVO OCV for each exhaust valve, with corresponding prohibited periods and EEVO OCV response times that can vary from one another, the valvetrain 34 comprises only two EEVO OCVs A &B in FIGS. 10 & 11. Each EEVO OCV acts on three exhaust valves so that EEVO can be switched synchronously on half of the engine with one known EEVO OCV response time.

To implement the novel OCV layout, new CDA OCV block 90 ("first block") and new EEVO OCV block 80 ("second block") are shown in FIGS. 5A, 5B, 8A & 8B. The new blocks are mounted to stationary rocker shaft 500. Stationary rocker shaft 500 comprises improvements that mate to the new blocks and streamlined interior fluid connections.

Figure 5B:
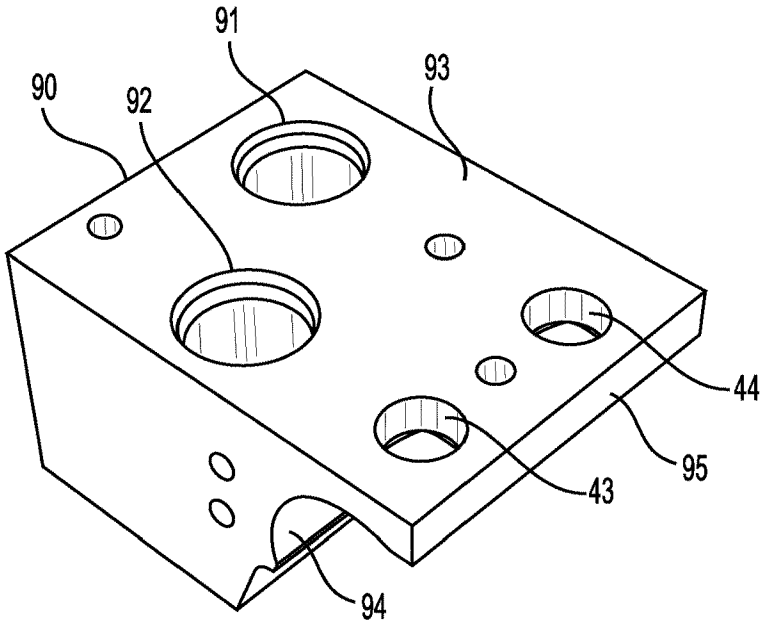
FIGS. 5A & 5B are views of a first block for mounting oil control valves.
Figure 5A:
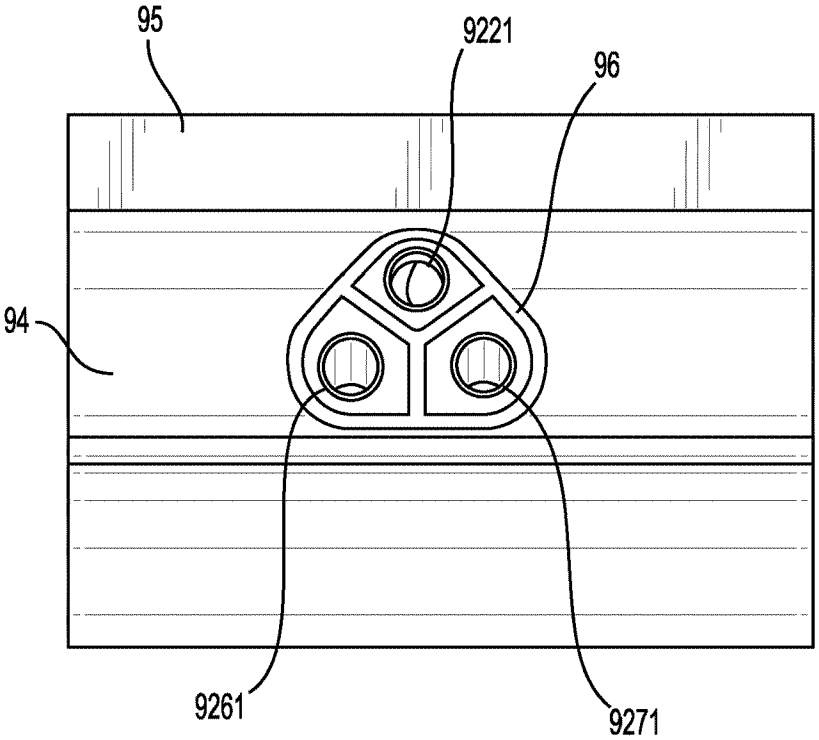

The design of CDA OCV block 90 of FIGS. 5A & 5B is conducive to housing CDA OCVs 1 & 2 or CDA OCVs 5 & 6. Drop-in openings 91 & 92 in upper surface 93 permit ease of assembly & ease of serviceability and receive respective CDA OCVs. Fastener holes 43, 44 in ledge 95 can accept fasteners 6544, 6543 such as bolts, rivets, screws, or the like to anchor the CDA OCV block 90 to fastener receiving holes 541, 542 in rocker shaft 500. A CDA rocker face 94 abuts the rocker shaft 500. A gland 96 can be formed in CDA rocker face 94 to receive a seal or sealant to give fluid-tight contact. A single CDA oil port 9221 is configured to receive supply oil from rocker shaft supply oil feed duct 510 by way of CDA oil infeed 522. As shown schematically in FIG. 11, the single CDA oil port 9221 into the CDA OCV block 90 splits internally to supply oil to each CDA OCV 1& 2 or 5 & 6. The CDA OCVs receive the supply oil and direct it out through CDA output oil ports 9261 & 9271 to CDA oil outfeeds 526 & 527.

Rocker shaft 500 comprises a CDA outfeed duct 520 parallel to the supply oil feed duct 510. The CDA oil outfeed duct 520 distributes the supply oil from the CDA OCVs to respective intake rocker arms 611, 612, 613. A single CDA outfeed duct 520 can span the length of the rocker shaft 500, leading to simplicity of manufacture. End plugs can seal the ends of the CDA outfeed duct 520. Then, CDA channel dividers 581, 582 can intersect the CDA outfeed duct 520 and additional plugs can divide the CDA outfeed duct 520 into the three CDA hydraulic lines 5201, 5202, 5203. Deactivation and reactivation of all valves of each cylinder can be discretely controlled independent of the other cylinders using this divided CDA outfeed technique.

As shown in the schematic, CDA OCV 1, if seated in opening 91, would receive the supply oil split from CDA oil port 9221 and direct it to CDA output oil port 9271 and CDA oil outfeed 526. Traversing CDA hydraulic line 5201, the supply oil would then exit intake rocker arm port 571 to enter intake rocker arm 611 and act on intake CDA capsule I1 and also exit exhaust rocker arm port 561 to enter exhaust rocker arm 621 and act on exhaust CDA capsule E1.

CDA OCV 2, if seated in opening 92, would receive the supply oil split from CDA oil port 9221 and direct it to CDA output oil port 9261 and CDA oil outfeed 527. Traversing CDA hydraulic line 5202, the supply oil would then exit intake rocker arm port 572 to enter intake rocker arm 612 and act on intake CDA capsule I2 and also exit exhaust rocker arm port 562 to enter exhaust rocker arm 622 and act on exhaust CDA capsule E2.

Figure 8B:
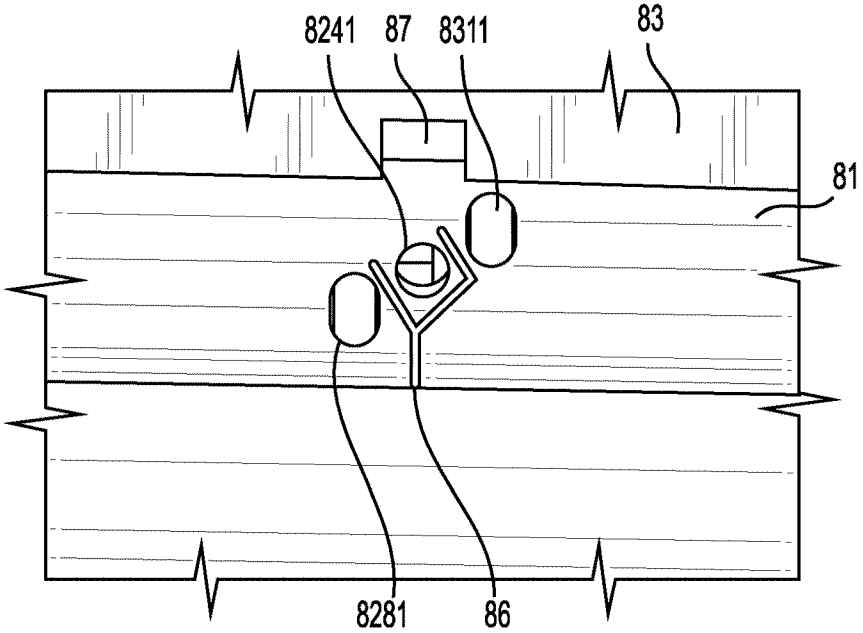
FIGS. 8A & 8B are views of a second block for mounting oil control valves.
Figure 8A:
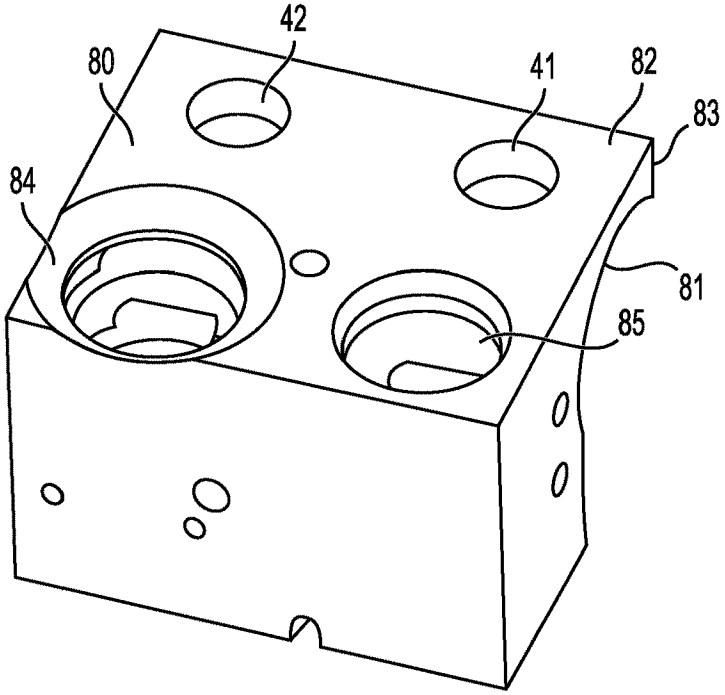

The EEVO OCV block 80 of FIGS. 8A & 8B is conducive to housing EEVO OCV A with CDA OCV 3 or to housing EEVO OCV B with CDA OCV 4. Again, an economy in engineering and design permits a single shared inlet oil port 8241 to provide supply oil and input fluid pressure from supply oil feed duct 510 via inlet oil infeed 524 to the EEVO OCV and the CDA OCV. Yet, each of the EEVO OCV and the CDA OCV have their own outfeeds out of the EEVO OCV block 80.

Drop-in openings 84, 85 in upper surface 82 permit ease of assembly & ease of serviceability and receive EEVO OCV in opening 84 and CDA OCV in opening 85. Fastener holes 41, 42 in ledge 83 can accept fasteners 6542, 6541 such as bolts, rivets, screws, or the like to anchor the EEVO OCV block 80 to fastener receiving holes 543, 544 in rocker shaft 500. A coupling rocker face 81 abuts the rocker shaft 500. A gland 86 can be formed in coupling rocker face 81 to receive a seal or sealant to give fluid-tight contact. Also, a fluid notch 87 can be formed with or without the gland 86.

A single inlet oil port 8241 is configured to receive supply oil from rocker shaft supply oil feed duct 510 by way of inlet oil infeed 524. As shown schematically in FIG. 11, the single inlet oil port 8241 into the EEVO OCV block 80 splits internally to supply oil to an CDA OCV 3 or 4 and to an EEVO OCV A or B. The respective CDA OCV receives the supply oil and directs it out through CDA output oil port 8281 to CDA oil outfeed 528. The respective EEVO OCV receives the supply oil and directs it out through EEVO output oil port 8311 to EEVO oil outfeed 531.

Rocker shaft 500 comprises an EEVO outfeed duct 530 parallel to the supply oil feed duct 510 and parallel to the CDA outfeed duct 520. The EEVO outfeed, supply oil feed, and CDA outfeed can each span the rocker shaft with capping or other plugging at end 504. The EEVO oil outfeed duct 530 distributes the supply oil from the EVO OCV to respective exhaust valves via rocker arms 900 and EEVO capsules 801, 802, 803. A single EEVO outfeed duct 530 can span the length of the rocker shaft 500, leading to simplicity of manufacture. End plugs can seal the ends of the EEVO outfeed duct 530. Implementation of early exhaust valve opening operation mode can be implemented on half the cylinders of the engine with the same response time and valve timing using this EEVO outfeed technique.

As shown in the schematic, EEVO OCV A, if seated in opening 84, would receive the supply oil split from inlet oil port 8241 and direct it to EEVO output oil port 8311 and EEVO oil outfeed 531. Traversing EEVO hydraulic line 5301 (part of EEVO outfeed duct 530), the supply oil would then exit the rocker shaft at EEVO rocker arm ports 591, 592, 593 to traverse respective rocker arms 911, 912, 913 and actuate respective EEVO capsules 801, 802, 803.

CDA OCV 3, if seated in opening 85, would receive the supply oil split from inlet oil port 8241 and direct it to CDA output oil port 8281 and CDA oil outfeed 528. Traversing CDA hydraulic line 5203, the supply oil would then exit intake rocker arm port 573 to enter intake rocker arm 613 and act on intake CDA capsule I3 and also exit exhaust rocker arm port 563 to enter exhaust rocker arm 623 and act on exhaust CDA capsule E3.

Figure 11:
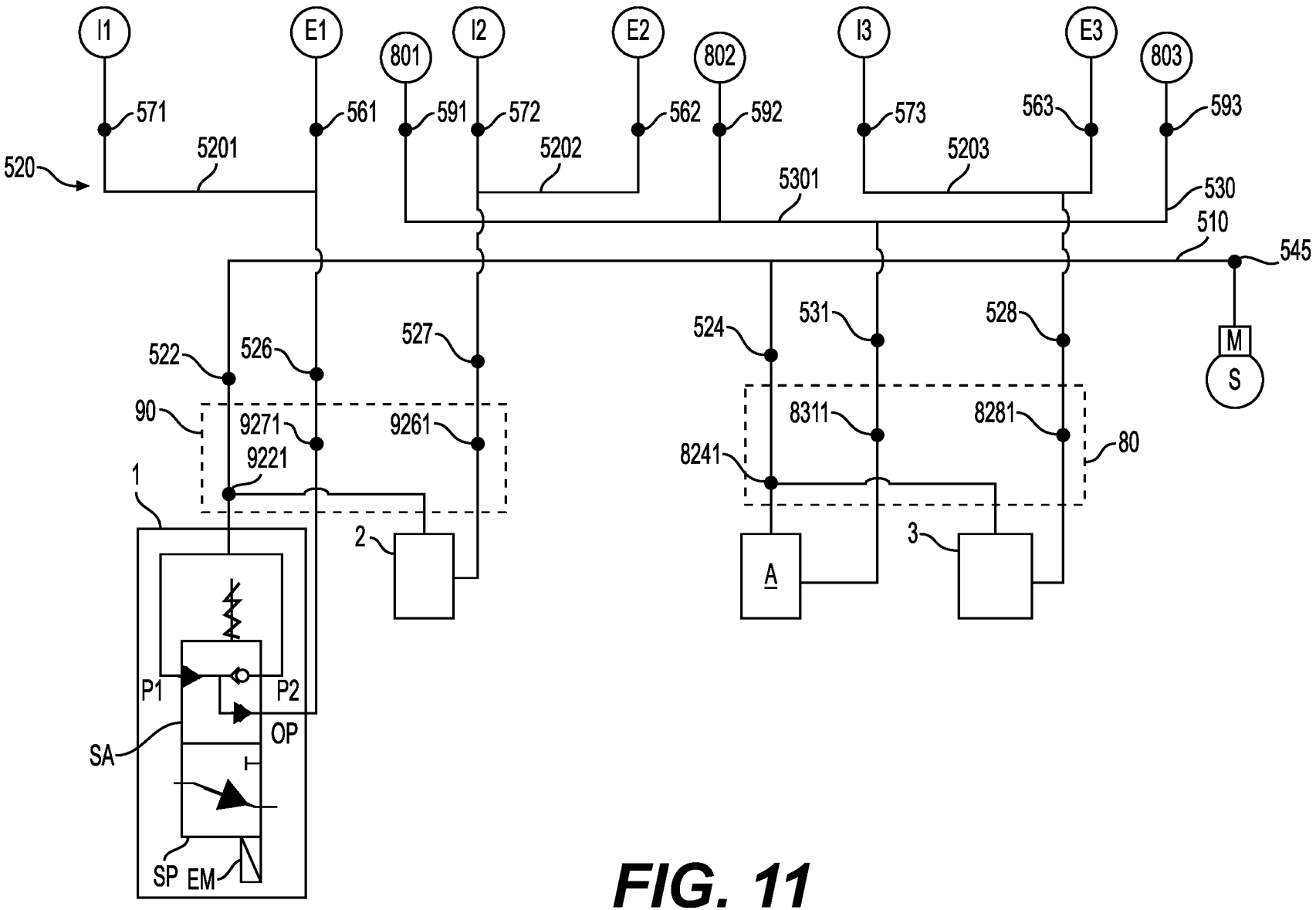
FIG. 11 is an abridged schematic of fluid flow paths in the engine system.

Each of the OCVs can be of the same internal structure as shown in the schematic OCV circuit of FIG. 11 for CDA OCV 1. The OCV circuit shows that, in a passive state SP, supply oil is restricted to a low first pressure P1 that can flow through as outlet pressure OP. The low pressure can be constantly flowed through the OCV when the OCV is passive and not actively powered. When the OCV is in an active state SA, as controlled by an electromagnetic control signal from electromagnet EM, an additional high pressure P2 flows through the OCV to be outlet pressure OP. Low pressure P1 and high pressure P2 can be drawn from a single high pressure supply oil from supply oil feed duct 510 without need to switch the pressure on supply oil feed duct 510 by way of sized openings and application of fluid flow dynamics.

Alternatively, simple on/off OCVs can be used instead of the dual pressure OCVs. Electromagnetic switching is discussed, but alternatives such as electromechanical switching, among others, can be used.

Figure 10:
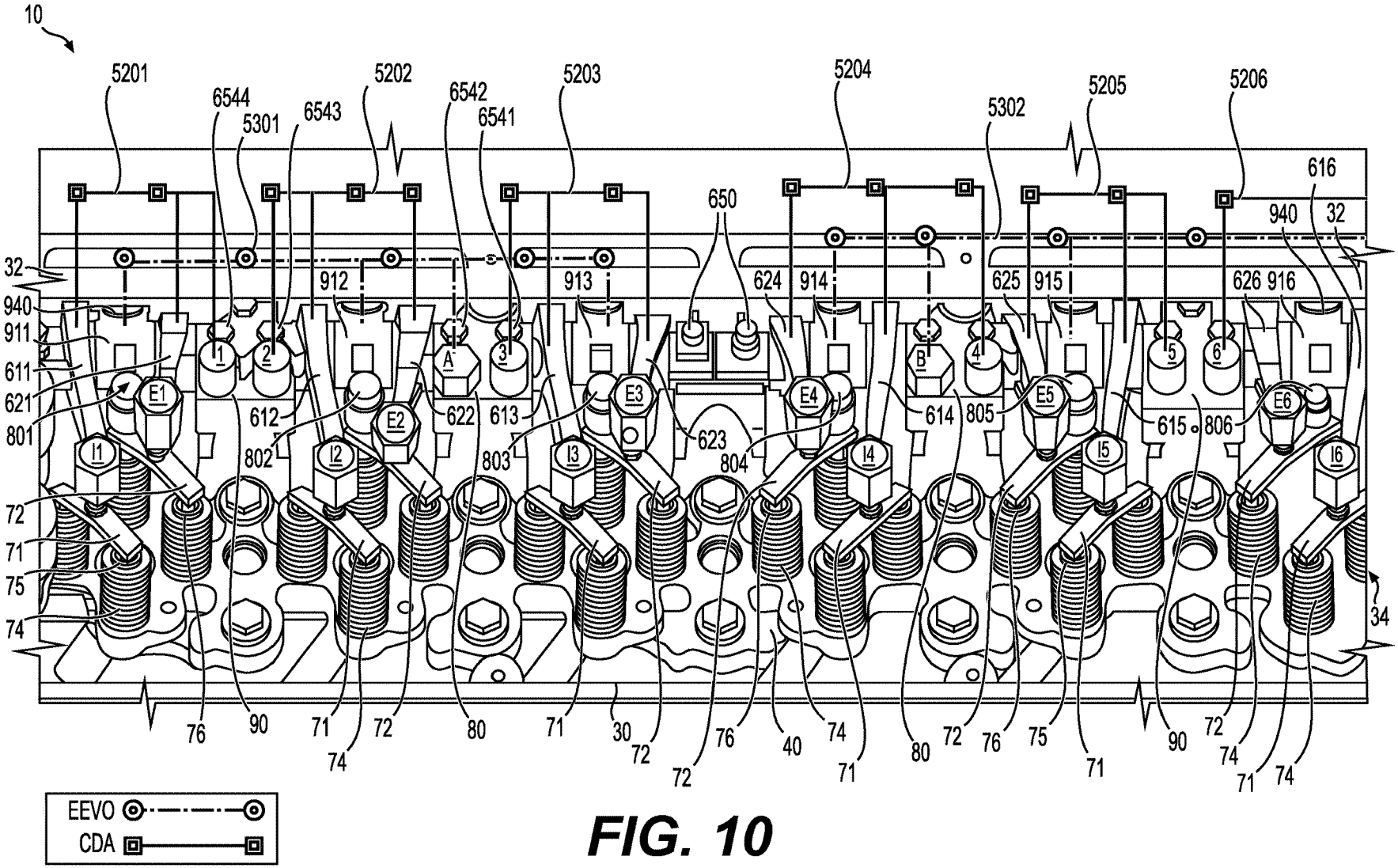
FIG. 10 is a view of a valvetrain configured for selectively implementing normal operation mode, cylinder deactivation operation mode, and early exhaust valve opening mode. An abridged schematic of rocker shaft fluid flow paths is included.

The rocker shaft 500 is shown for three cylinders of six cylinders, so two rocker shafts can be used in mirror image to one another, as shown in FIG. 10, among other integration and separation techniques. CDA hydraulic lines 5204, 5203, 5206 can mirror CDA hydraulic lines 5203, 5202, 5201. EEVO hydraulic line 5302 can mirror EEVO hydraulic line 5301. Rocker shaft can comprise ends 503, 504. A coupling opening 545 can be included to accept a coupler 650 that mounts the rocker shaft 500 to the engine block 30. A through-hole 501 can be drilled and plugged to connect supply oil from the engine system 10 to the supply oil feed duct 510. Flats 502, 503 can assist with positioning and coupling, as necessary.

Figure 4A:
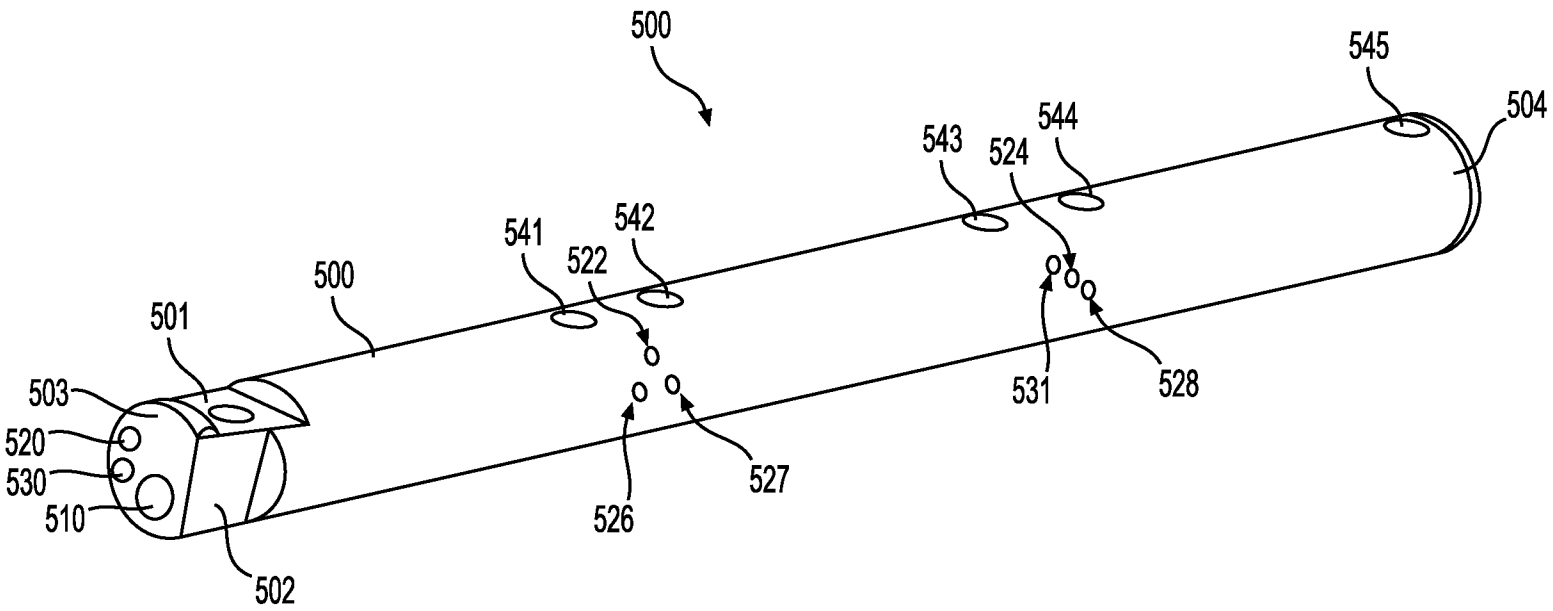
FIGS. 4A-4C are views of a rocker shaft.
Figure 4B:
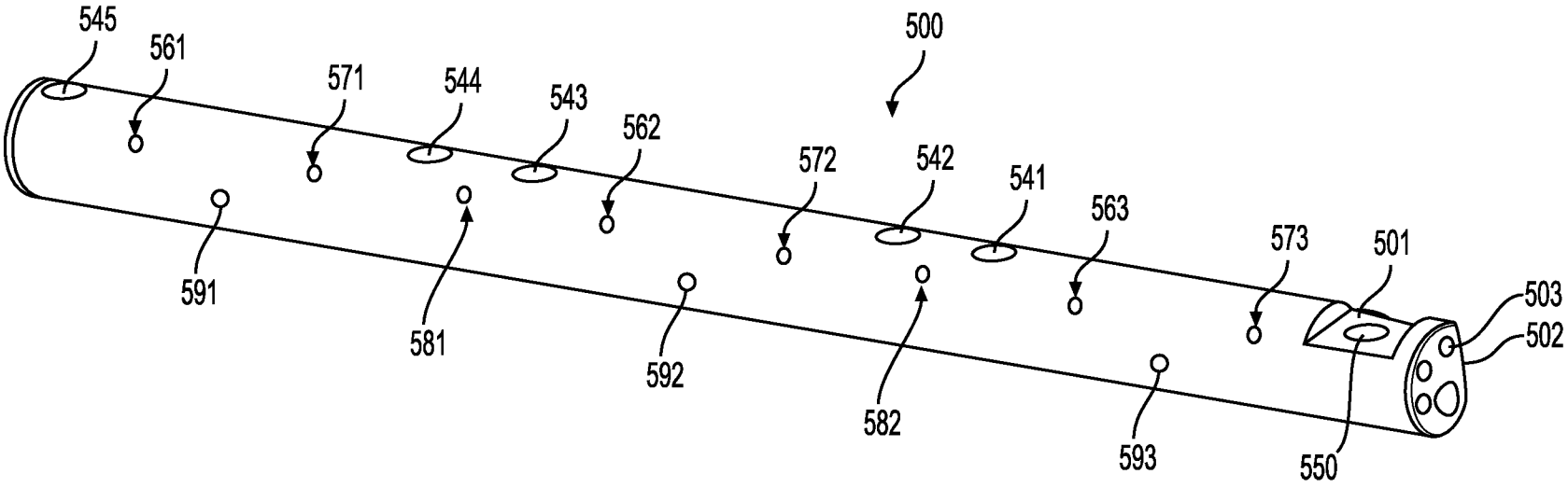
Figure 4C:
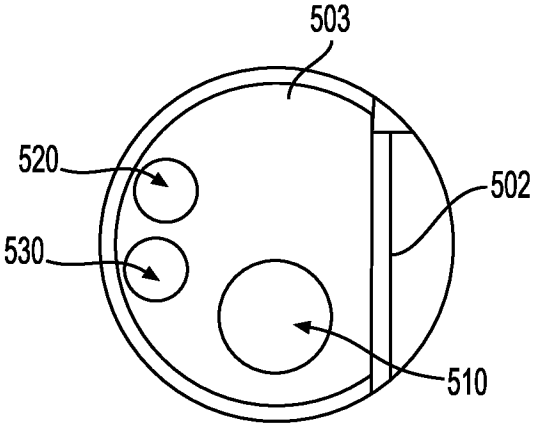

What can be seen in FIGS. 4A, 4B and 10 is the linear array of oil feed, oil outfeeds, EEVO ports and rocker arm ports. An orderly series of rocker arms can be distributed along the rocker shaft 500 with good spacing between the EEVO ports 591, 592, 593 and CDA intake and exhaust rocker arm ports 561, 571, 562, 572, 563, 573, permitting good isolation of control signals between normal, CDA and EEVO operation modes. With the CDA OCV block 90 and EEVO OCV block 80 mounted directly to the rocker shaft, leak pathways are minimized and good optimization of parallel distribution lines is made. Outstanding access is given to top of the valvetrain 34 and all of its serviceable components, yielding good installation and maintenance processes. There is no need to remove a first layer of oil controlled components to access a second layer of oil control components. There is no crossing or overlapping of rocker arms or capsules. For example, the EEVO capsules 801-803 can be adjusted and serviced without adjusting the CDA capsules I1-I6 or E1-E6 and vice versa. Lash adjusting operations can be performed without moving rocker arms out of the way of the lash capsules. So, the engine system 10, as laid out, has many advantages.

FIG. 6 comprises a CDA rocker arm 600 representative of the intake and exhaust rocker arms 611-616 and 621-626. CDA rocker arm comprises a rocker bore 602 for surrounding the rocker shaft 500. Oil pathways 612, 610 can be included leading supply oil away from the respective rocker arm port of the rocker shaft. For example, oil pathway 610 can lead supply oil to lubricate roller 661 interfacing with cam lobe 61 and cam rail 60. Oil pathway 612 can extend through arm 601 to bring supply oil up to the CDA capsule 700 in capsule cup 631 of capsule end 670. Oil pathway 612 can be formed, for example, by drilling or casting a form through end 614 back to rocker bore 602.

Supply oil fed to capsule cup 631 can be contained by interfacing surface of the capsule cup 631 and upper outer body 701 of the CDA capsule. Additional measures can comprise a sealing cap 770, an o-ring in a seat around capsule bottom 757, among other measures. Supply oil traverses leak down paths in middle outer body 756 and capsule cup 631. Supply oil reaches latch groove 755. When low pressure P1 is supplied, the CDA capsule is primed and passively in a latched condition, thereby transferring the full motion of the rocker arm down to stroke the valves open and closed.

When high pressure P2 is supplied, it collapses the latches 722 of the latch assembly 750 and compresses the latch spring 752. The CDA capsule 700 now provides "lost motion" via lost motion springs 740. The capsule collapses, the latch assembly 750 slides up and pushes lash cup 730 up in to upper lash chamber 741 when the rocker arm rocks. The rocker arm motion is not transferred to the valves during this cylinder deactivation mode (CDA). Upon reactivation of the valves, the high pressure P2 is removed as the corresponding CDA OCV valve is returned to a passive state SP. The lost motion springs 740 overcome low fluid pressure P1 and push the lash cup 730 back toward the valves, and the latch assembly re-engages with latches 722 pushed by latch spring 752 back to latch groove 755. Excess oil can traverse bleeds like bleed 732 and bleeds in the lower outer body 733 and e-foot attachment 711 and e-foot 712.

The CDA capsule 700 in the CDA rocker arm 600 can be mechanically set for lash while including a hydraulic lash aspect. The CDA capsule lash can be set mechanically, as by screwing the capsule in place as when interfacing threading on upper outer body 701 and upper capsule cup 630. Threading and mechanical lash setting aspects can alternatively be included in the interface of sealing cap 770 and the upper outer body 701. A shim 760, a snap ring 780, and a lid 790 can contain the lost motion springs 740 within the upper lash chamber 741. A hex or other feature 791 can be included in the lid 790 to effectuate rotation of the CDA capsule within the capsule cup 630. Adjusting the height of the CDA capsule by screwing it in or out sets mechanical lash. Then, a hydraulic internal set-up can provide hydraulic lash to the rocker arm. The low pressure P1 can be selected to provide a baseline pressure in the upper lash chamber for hydraulic lash provisions. The CDA capsule 700 is serviceable. A baseline hydraulic pressure to the capsule can provide for lash while a change in pressure can actuate the spring-loaded latch for facilitating lost motion during CDA. The CDA rocker arm 600 can be used to press on the valve bridge 71 over the intake valves 13 or to press on the valve bridge 72 over the exhaust valves 14.

FIG. 9 shows the EEVO rocker arm 900 representative of EEVO rocker arms 911-916. EEVO rocker arm 900 facilitates early exhaust valve opening for one of the pair of exhaust valves 14 by pressing on valve cleat 79, as discussed above. Body 903 comprises a seat for roller 962 configured to roll against cam lobe 62 on cam rail 61. A first lost motion spring 940 abuts body 903 and is biased against a lid 32 affiliated with valvetrain 34. EEVO rocker arm 900 comprises a rocker bore 902 for surrounding rocker shaft 500. Supply oil from respective EEVO port 591-593 is fed to internal pathway 912 in arm 901 to EEVO capsule cup 981.

An EEVO capsule 800 representative of EEVO capsules 801-806 is set in the EEVO rocker arm 900. The EEVO capsule can comprise one or both of a mechanical lash setting aspect and a hydraulic lash setting aspect. A mechanical lash setting aspect can be achieved by manipulating a hex or other coupling 851 in a lid 852. Lid 852 can fit against top cup 821 with a snap ring 860 and a shim 850. Like above, screwing the EEVO capsule up or down can mechanically set lash. A cap 870 can surround top cup 821 and can abut capsule cup 981.

Capsule body can comprise top cup 821, bottom cup 823, shoulder 822, and through-hole 824. Supply oil from pathway 912 reaches through-hole 824. At low pressure P1, the inner cup 830 is spaced from shim 850 and biased by a capsule lost motion spring 840. A frit 831 can extend from the inner cup to space the inner cup 830 with respect to the check 815, push the check down, and restrict the travel of the inner cup. Low pressure oil P1 can enter a lash hat 814 and lash chamber 813. Lash spring 816 can bias lash body 810 and cleat seat 812, and biasing members 74 can oppose. With low pressure oil P1 trapped in lash chamber 813, hydraulic lash can apply, with the check 815 rising to shoulder 822 during rocker arm motion and valve actuation. With high pressure oil P2 supplied to through-hole 824, the capsule lost motion spring force is overcome and the inner cup 830 rises to seat against shim 850 and trap fluid in top cup 821. High pressure expands the compartment 817 formed in bottom cup 823 and pushes lash body 810 out. Early exhaust valve opening can occur with the adjusted size of compartment 817. Using the arrangement, a baseline hydraulic pressure provides lash adjustment. A change in pressure from low pressure P1 to high pressure P2 causes the EEVO rocker arm 900 to open the corresponding exhaust valve earlier than the bridge 72 connected to the CDA rocker arm 600 would open that valve.

Other implementations will be apparent to those skilled in the art from consideration of the specification and practice of the examples disclosed herein.

What is claimed is:

1. An oil control assembly, comprising:

a rocker shaft, comprising:

a common internal supply oil feed duct spanning within the rocker shaft;

a first outfeed duct parallel to the common internal supply oil feed duct; and a second outfeed duct parallel to the common internal supply oil feed duct;

a first block configured to house a first oil control valve and a second oil control valve, the first block comprising:

a first oil inlet port connected to the common internal supply oil feed duct and configured to supply hydraulic pressure to the first oil control valve and to the second oil control valve;

a first output oil port configured to connect to the first oil control valve; and a second output oil port configured to connect to the second oil control valve; and a second block configured to house a third oil control valve and a fourth oil control valve, the second block comprising:

a second oil inlet port connected to the common internal supply oil feed duct and configured to supply the hydraulic pressure to the third oil control valve and to the fourth oil control valve;

a third output oil port configured to connect to the third oil control valve; and a fourth output oil port configured to connect to the fourth oil control valve.

2. The oil control assembly of claim 1, wherein the first outfeed duct is fluidly connected to the first oil control valve, the second oil control valve, and the third oil control valve.

3. The oil control assembly of claim 2, wherein the second outfeed duct is fluidly connected to the fourth oil control valve.

4. The oil control assembly of claim 1, wherein the second outfeed duct is fluidly connected to the fourth oil control valve.

5. The oil control assembly of claim 1, wherein the rocker shaft further comprises at least one plug in a channel divider connected to the first outfeed duct, the at least one plug configured to fluidly separate first oil from the first output oil port and second oil from the second output oil port.

6. The oil control assembly of claim 1, wherein the rocker shaft further comprises:

a first oil infeed connected to the first oil inlet port and to the common internal oil supply feed duct; and a second oil infeed connected to the second oil inlet port and to the common internal oil supply feed duct.

7. The oil control assembly of claim 6, wherein the rocker shaft further comprises:

a first oil outfeed connected to the first output oil port and to the first outfeed duct; and a second oil outfeed connected to the second output oil port and to the first outfeed duct.

8. The oil control assembly of claim 7, wherein the rocker shaft further comprises:

a third oil outfeed connected to the third output oil port and to the first outfeed duct; and a fourth oil outfeed connected to the fourth output oil port and to the second outfeed duct.

9. The oil control assembly of claim 1, wherein the rocker shaft further comprises:

a first oil outfeed connected to the first output oil port and to the first outfeed duct; and a second oil outfeed connected to the second output oil port and to the first outfeed duct.

10. The oil control assembly of claim 9, wherein the rocker shaft further comprises:

a third oil outfeed connected to the third output oil port and to the first outfeed duct; and a fourth oil outfeed connected to the fourth output oil port and to the second outfeed duct.

11. An engine system, comprising:

a valvetrain comprising a first cylinder, a second cylinder, and a third cylinder such that each cylinder comprises:

an intake rocker arm configured to act on a set of intake valves via an intake valve bridge, the intake rocker arm including an intake hydraulic capsule;

an exhaust rocker arm configured to act on a set of exhaust valves via an exhaust valve bridge, the exhaust rocker arm including an exhaust hydraulic capsule; and a variable valve actuation (VVA) rocker arm configured to engage the exhaust valve bridge, the VVA rocker arm including a VVA hydraulic capsule;

a rocker shaft, comprising:

a common internal supply oil feed duct spanning within the rocker shaft;

a first outfeed duct parallel to the common internal supply oil feed duct; and a second outfeed duct parallel to the common internal supply oil feed duct;

a first block connected to the rocker shaft, the first block configured to house a first oil control valve and a second oil control valve, the first block comprising:

a single first inlet oil port connected to the common internal supply oil feed duct and to the first oil control valve and to the second oil control valve;

a first output oil port connected to the first outfeed duct and to the first oil control valve; and a second output oil port connected to the first outfeed duct and to the second oil control valve; and a second block connected to the rocker shaft, the second block configured to house a third oil control valve and a fourth oil control valve, the second block comprising:

a single second inlet oil port connected to the common internal supply oil feed duct and to the third oil control valve and to the fourth oil control valve;

a third output oil port connected to the first outfeed duct and to the third oil control valve; and a fourth output oil port connected to the second outfeed duct and to the fourth oil control valve, wherein the first outfeed duct is configured to supply oil to each intake rocker arm and to each exhaust rocker arm; and wherein the second outfeed duct is configured to supply VVA oil to each VVA rocker arm.

12. The engine system of claim 11, wherein the first output oil port is connected to the intake hydraulic capsule and to the exhaust hydraulic capsule of the first cylinder, and wherein the second output oil port is connected to the intake hydraulic capsule and to the exhaust hydraulic capsule of the second cylinder.

13. The engine system of claim 11, wherein the intake rocker arm, the exhaust rocker arm, and the VVA rocker arm of each cylinder are arranged so as to not overlap each other during motion.

14. The engine system of claim 11, wherein the third output oil port is connected to the intake hydraulic capsule and to the exhaust hydraulic capsule of the third cylinder.

15. The engine system of claim 11, wherein the fourth output oil port is connected to each VVA rocker arm.

16. The engine system of claim 11, wherein the VVA rocker arm of each cylinder is configured to perform early exhaust valve opening via the VVA hydraulic capsule.

17. The engine system of claim 11, wherein the rocker shaft further comprises at least one plug connected to the first outfeed duct, the at least one plug configured to fluidly separate first oil from the first output oil port and second oil from the second output oil port.

18. An oil control assembly, comprising:

a rocker shaft, comprising:

a common internal supply oil feed duct spanning within the rocker shaft;

a first oil infeed and a second oil infeed coupled to the common internal supply oil feed duct;

a first outfeed duct parallel to the common internal supply oil feed duct;

a first oil outfeed, a second oil outfeed, and a third oil outfeed coupled to the first outfeed duct;

a second outfeed duct parallel to the common internal supply oil feed duct; and a fourth oil outfeed coupled to the second outfeed duct;

a first block configured to house a first oil control valve and a second oil control valve, the first block comprising:

a first oil inlet port connected to the first outfeed duct and configured to supply hydraulic pressure to the first oil control valve and to the second oil control valve;

a first output oil port configured to connect to the first oil control valve and to the first oil outfeed; and a second output oil port configured to connect to the second oil control valve and the second oil outfeed; and a second block configured to house a third oil control valve and a fourth oil control valve, the second block comprising:

a second oil inlet port connected to the second oil infeed and configured to supply the hydraulic pressure to the third oil control valve and to the fourth oil control valve;

a third output oil port configured to connect to the third oil control valve and to the third oil outfeed; and a fourth output oil port configured to connect to the fourth oil control valve and to the fourth oil outfeed.

* * * * *